US010185238B2

(12) United States Patent
Kamai et al.

(10) Patent No.: US 10,185,238 B2
(45) Date of Patent: Jan. 22, 2019

(54) CARRIER CORE MATERIAL

(71) Applicants: DOWA ELECTRONICS MATERIALS CO., LTD., Tokyo (JP); DOWA IP CREATION CO., LTD., Okayama-shi, Okayama (JP)

(72) Inventors: Yuto Kamai, Okayama (JP); Shinya Sasaki, Okayama (JP)

(73) Assignees: DOWA ELECTRONICS MATERIALS CO., LTD., Tokyo (JP); DOWA IP CREATION CO., LTD., Okayama (JP)

( * ) Notice: Subject to any disclaimer, the term of this patent is extended or adjusted under 35 U.S.C. 154(b) by 0 days.

(21) Appl. No.: 15/656,018

(22) Filed: Jul. 21, 2017

(65) Prior Publication Data

US 2018/0024455 A1 Jan. 25, 2018

(30) Foreign Application Priority Data

Jul. 22, 2016 (JP) ..... 2016-144056

(51) Int. Cl.
*G03G 9/107* (2006.01)
*G03G 9/113* (2006.01)

(52) U.S. Cl.
CPC ..... *G03G 9/107* (2013.01); *G03G 9/1075* (2013.01); *G03G 9/1131* (2013.01); *G03G 9/1132* (2013.01); *G03G 9/1138* (2013.01)

(58) Field of Classification Search
CPC ..... G03G 9/107; G03G 9/1132; G03G 9/1075
See application file for complete search history.

(56) References Cited

U.S. PATENT DOCUMENTS 6,790,522 B2 * 9/2004 Yamazaki ..... G11B 5/70678 428/842.8
2005/0013046 A1 * 1/2005 Noguchi ..... G11B 5/012 360/135
2010/0330492 A1 * 12/2010 Tsurumi ..... G03G 9/1075 430/111.1
2013/0316282 A1 * 11/2013 Ishigami ..... G03G 9/0833 430/111.33

FOREIGN PATENT DOCUMENTS

JP S60-19156 A 1/1985
JP 3294507 B2 * 6/2002

OTHER PUBLICATIONS

English language machine translation of JP 3294507 (Jun. 2002).*

* cited by examiner

*Primary Examiner* — Christopher D Rodee
(74) *Attorney, Agent, or Firm* — Oliff PLC

(57) ABSTRACT

A carrier core material is provided that is formed with ferrite particles which can uniformly adhere a coupling agent to the entire surface. A carrier core material is formed with ferrite particles, and the powder pH of the ferrite particles is equal to or more than 9. Here, the ferrite particles are preferably formed of Mn ferrite or Mn—Mg ferrite. The ferrite particles preferably contain 45 wt % or more but 65 wt % or less of Fe, 15 wt % or more but 30 wt % or less of Mn and 5 wt % or less of Mg.

13 Claims, No Drawings

CARRIER CORE MATERIAL

TECHNICAL FIELD

The present invention relates to a carrier core material and the like, and more specifically relates to a carrier core material and the like formed with ferrite particles.

BACKGROUND ART

For example, in an image forming apparatus using an electrophotographic system, such as a facsimile, a printer or a copying machine, a toner is adhered to an electrostatic latent image formed on the surface of a photosensitive member to visualize it, the visualized image is transferred to a sheet or the like and thereafter it is fixed by being heated and pressurized. In terms of achieving high image quality and colorization, as a developer, a so-called two-component developer containing a carrier and a toner is widely used.

In a development system using a two-component developer, a carrier and a toner are agitated and mixed within a development device, and the toner is charged by friction so as to have a predetermined amount. Then, the developer is supplied to a rotating development roller, a magnetic brush is formed on the development roller and the toner is electrically moved to the photosensitive member through the magnetic brush to visualize the electrostatic latent image on the photosensitive member. The carrier after the movement of the toner is left on the development roller, and is mixed again with the toner within the development device. Hence, as the properties of the carrier, a magnetic property for forming the magnetic brush, a charging property for providing a desired charge to the toner and durability in repeated use are required.

As such a carrier, carriers in which various types of ferrite particles are used as carrier core materials and whose surfaces are coated with a resin are generally used. However, a resin coating layer is often separated from the surface of the carrier core material such as by the collision or friction of carriers themselves or carriers and the development device. When the resin coating layer is separated from the carrier core material, a charging property and an electrical property are changed, and thus the image quality is lowered.

Hence, in order to enhance the adhesion of the carrier core material and the resin coating layer, various types of technologies are proposed. For example, patent document 1 proposes a technology in which a layer containing a silane coupling agent is interposed between a carrier core material and a resin coating layer.

RELATED ART DOCUMENT

Patent Document

Patent Document 1: Japanese Unexamined Patent Application Publication No. 60-19156

DISCLOSURE OF THE INVENTION

Problems to be Solved by the Invention

According to the proposed technology, the adhesion of the carrier core material and the resin coating layer is considered to be enhanced. However, it is not always easy to uniformly adhere the coupling agent to the entire surface of the carrier core material. When the adherence of the coupling agent to the surface of the carrier core material is not uniform, in a portion to which a small amount of coupling agent is adhered, the adhesion of the carrier core material and the resin coating layer is low, with the result that the resin coating layer may be separated.

The present invention is made in view of the conventional problems described above, and an object thereof is to provide a carrier core material in which a coupling agent can be uniformly adhered to the entire surface and which is formed with ferrite particles.

Another object of the present invention is to provide an electrophotographic development carrier and an electrophotographic developer which can stably form satisfactory quality images even in long-term use.

Means for Solving the Problem

In order to achieve the above objects, according to the present invention, there is provided a carrier core material that is formed with ferrite particles where the powder pH of the ferrite particles is equal to or more than 9. In the present specification, the "powder pH" refers to a value which was measured by a measurement method described in examples to be discussed later.

The ferrite particles are preferably formed of Mn ferrite or Mn—Mg ferrite.

The ferrite particles preferably contain 45 wt % or more but 65 wt % or less of Fe, 15 wt % or more but 30 wt % or less of Mn and 5 wt % or less of Mg.

The ferrite particles preferably contain 0.1 wt % or more but 3.0 wt % or less of Sr and/or Ca as the total amount.

In the configuration described above, the total content of the elements of Al, Cr, Mo, Si and Ti in the ferrite particles is preferably equal to or less than 0.15 wt %.

The average length RSm of the ferrite particles is preferably equal to or more than 7 μm but equal to or less than 8 μm.

The maximum height Rz of the ferrite particles is preferably equal to or more than 1.5 μm but equal to or less than 3.0 μm.

A magnetization $\sigma_{1k}$ is preferably equal to or more than 50 $Am^2/kg$ but equal to or less than 70 $Am^2/kg$.

In the configuration described above, the coupling agent is preferably adhered to the surface of the ferrite particles.

The coupling agent is preferably a coupling agent which includes at least one type selected from a group consisting of an amino group, an epoxy group, a methacryl group, a vinyl group, a mercapto group, an isocyanate group and an alkyl group.

According to the present invention, there is provided an electrophotographic development carrier that has a resin coating layer on the surface of the carrier core material in which the coupling agent is adhered to the surface of the ferrite particles.

Furthermore, according to the present invention, there is provided an electrophotographic developer which contains the electrophotographic development carrier described above and a toner.

Advantages of the Invention

In the carrier core material of the present invention, the coupling agent can be uniformly adhered to the entire surface of the ferrite particles. In this way, in the electrophotographic development carrier in which the resin coating layer is further formed on the surface of the ferrite particle to which the coupling agent is adhered, the separation of the resin coating layer is reduced even in long-term use. Even when the carrier core material is used for a high-speed image forming apparatus, the separation of the resin coating layer is reduced.

In the electrophotographic development carrier and the electrophotographic developer according to the present invention, it is possible to stably form satisfactory quality images even in long-term use.

DESCRIPTION OF EMBODIMENTS

The present inventors et al. have conducted a thorough study for uniformly adhering a coupling agent to the entire surface of ferrite particles forming a carrier core material, and consequently have found that the pH of the powder of the ferrite particles is set equal to or more than a predetermined value such that the present invention has been achieved.

The coupling agent includes, in its molecule, a reactive group which is chemically bonded to an inorganic material and a reactive group which is chemically bonded to an organic material, and has the function of strongly bonding the carrier core material and a coating resin together. For example, a silane coupling agent includes an organic functional group for bonding to an organic material and a hydrolyzable group such as "— OR". When the surface of the ferrite particles is processed by an aqueous solution of the silane coupling agent, a hydrolyzable group such as an alkoxyl group is hydrolyzed, and thus a silanol group (Si—OH) and an alcohol are produced. The silanol group is transferred to the surface through a hydroxyl group and a hydrogen bond on the surface of the ferrite particles, is thereafter subjected to a dehydration condensation reaction and then forms a strong covalent bond to the surface of the ferrite particles. At the same time, silanol groups condense with each other to form a siloxane bond (Si—O—Si), and a silane oligomer is formed.

Hence, as a larger amount of hydroxyl group is included in the ferrite particles, the silanol group of the coupling agent produced by the hydrolysis is hydrogen-bonded to the hydroxyl group on the surface of the ferrite particles, and the coupling agent is transferred to the surface of the ferrite particles, with the result that the surface of the ferrite particles is uniformly covered with the coupling agent. Hence, in the present invention, as an index for the amount of hydroxyl group included in the ferrite particles, a powder pH is used, and its value is set equal to or more than 9.

The reaction rate of the hydrolysis reaction and the condensation reaction described above depends on the pH of the solution and the like, and in the case of the silane coupling agent, the reaction rate of the hydrolysis is minimized when the pH is about 7 whereas the reaction rate is increased as the pH is increased from 7. The reaction rate of the condensation reaction is minimized when the pH is about 4 whereas the reaction rate is increased as the pH is increased from 4. Since in the present invention, the powder pH of the ferrite particles is set equal to or more than 9, when the ferrite particles are processed with the coupling agent solution, the pH of the processing solution is increased by the influence of the hydroxyl group included in the ferrite particles, and the hydrolysis reaction and the condensation reaction in the coupling agent proceed rapidly, with the result that the surface of the ferrite particles is reliably and uniformly covered with the coupling agent. In the present invention, the powder pH is more preferably equal to or more than 10. The upper limit value of the powder pH is preferably 12.

Since the powder pH of the ferrite particles is affected by components eluted from the ferrite particles, it is possible to control the powder pH such as by the mixed amount of alkaline earth metal components such as Ca, Sr, Ba and Ra in the ferrite particles and the calcination conditions of the ferrite particles. For example, since the alkaline earth metal reacts with water to form a hydroxide, the amount of alkaline earth metal mixed is increased, and thus it is possible to increase the powder pH of the ferrite particles. When the calcination conditions are set to a high temperature, a small amount of oxygen and a long period of time, the alkaline earth metal elements which are formed into ferrites are reduced and decomposed, with the result that it is also possible to increase the powder pH of the ferrite particles by use of the above-mentioned calcination conditions. A specific method of controlling the powder pH will be described in a method of manufacturing the ferrite particles which will be discussed later.

The composition of the ferrite particles in the present invention is not particularly limited, and as an example, there are particles whose composition is represented by a general formula $M_xFe_{3-x}O_4$ (where M is a metal such as Mg, Mn, Cu, Zn or Ni, $0<X<1$). Sr and Ca are preferably contained. More specifically, the ferrite particles preferably contain 45 wt % or more but 65 wt % or less of Fe, 15 wt % or more but 30 wt % or less of Mn and 5 wt % or less of Mg. Furthermore, the ferrite particles preferably contain 0.1 wt % or more but 3.0 wt % or less of Sr and/or Ca as the total amount. The predetermined amount of Sr and/or Ca is contained, and thus in a calcination step, a Sr ferrite and/or a Ca ferrite is partially generated, and a magnetoplumbite crystal structure is formed, with the result that a concave-convex shape in the surface of the ferrite particles is easily facilitated On the other hand, the total content of elements of Al, Cr, Mo, Si and Ti is preferably equal to or less than 0.15 wt %. This is because when these elements are contained, they form a solid solution with an alkaline earth metal element, for example, $SrTiO_3$ or $SrSiO_3$ is generated and consequently, a hydroxide of the alkaline earth metal is unlikely to be generated and thus the powder pH is unlikely to be increased.

The average length RSm of the ferrite particles is preferably equal to or more than 7 μm but equal to or less than 8 μm. The maximum height Rz of the ferrite particles is preferably equal to or more than 1.5 μm but equal to or less than 3.0 μm. In the surface of the ferrite particles, the minute and uniform concave and convex portions described above are formed, and thus when the surface of the particles is coated with a resin, it is possible to uniformly apply the coating resin, with the result that the coating resin is unlikely to be separated even in long-term use. Even when part of the coating resin is separated, a decrease in charging provision performance for a toner is reduced by the coating resin left in the concave portions. Furthermore, the cracking or chipping of the particles is also reduced.

In the carrier core material of the present invention, a magnetization $\sigma_{1k}$ in an applied magnetic field of 1000 $A/m \cdot 10^3/(4\pi)$ is preferably equal to or more than 50 $Am^2/kg$ but equal to or less than 70 $Am^2/kg$. When the magnetization $\sigma_{1k}$ is less than 50 $Am^2/kg$, the magnetic force of a development roller is unlikely to act, and thus the scattering of a carrier or the like may occur. On the other hand, when the magnetization $\sigma_{1k}$ exceeds 70 $Am^2/kg$, the electrical resistance may be lowered.

The particle diameter of the carrier core material of the present invention is not particularly limited, and the volume average particle diameter preferably falls within a range of 20 to 60 μm, and the particle size distribution is preferably sharp.

A method of manufacturing the ferrite particles forming the carrier core material of the present invention will then be described. Although the method of manufacturing the ferrite particles is not particularly limited, a manufacturing method which will be described below is preferable.

First, a Fe component raw material and a M component raw material are weighed, and thus a raw material mixed powder is produced. M is at least one type of metal element selected from a group of divalent metal elements consisting of Mg, Mn, Cu, Zn, Ni and the like. As necessary, a Sr component raw material or a Ca component raw material is added. As the Fe component raw material, $Fe_2O_3$ or the like is preferably used. As the M component raw material, for Mn, $MnCO_3$, $Mn_3O_4$ or the like is preferably used, and for Mg, Mgo, $Mg(OH)_2$ or $MgCO_3$ is preferably used. When the Sr component is added, $SrCO_3$, $Sr(NO_3)_2$ or the like is preferably used. When the Ca component is added, CaO, $Ca(OH)_2$, $CaCO_3$ or the like is preferably used. As described previously, the total content of elements of Al, Cr, Mo, Si and Ti which form a solid solution with an alkaline earth metal element is preferably equal to or less than 0.7 mass %.

Then, the produced raw material mixed powder is precalcined. The temperature of the precalcination preferably falls within a range of 750 to 900° C. Preferably, when the temperature of the precalcination is equal to or more than 750° C., the raw material mixed powder is partially formed into ferrites by the precalcination, a small amount of gas is produced at the time of the calcination and a reaction between solids sufficiently proceeds. On the other hand, preferably, when the temperature of the precalcination is equal to or less than 900° C., sintering caused by the precalcination is insufficient, and thus in a step of milling a slurry, it is possible to sufficiently mill the raw material. An atmosphere at the time of the precalcination is preferably the atmosphere.

Then, the precalcined raw material is disintegrated and is put into a dispersion medium so as to produce a slurry. The raw material mixed powder may be put into the dispersion medium without being precalcined so as to produce the slurry. As the dispersion medium used in the present invention, water is preferable. The precalcination raw materials described above and as necessary a binder, a dispersant and the like may be mixed into the dispersion medium. As the binder, for example, polyvinyl alcohol can be preferably used. As the amount of binder mixed, the concentration of the binder in the slurry is preferably set to about 0.5 to 2 mass %. As the dispersant, for example, polycarboxylic acid ammonium or the like can be preferably used. As the amount of dispersant mixed, the concentration of the dispersant in the slurry is preferably set to about 0.5 to 2 mass %. In addition, a lubricant, a sintering accelerator and the like may be mixed. The solid content concentration of the slurry preferably falls within a range of 50 to 90 mass %. The solid content concentration of the slurry more preferably falls within a range of 60 to 80 mass %.

Then, the slurry produced as described above is wet-milled. For example, a ball mill or a vibration mill is used to perform wet-milling for a predetermined time. The average particle diameter of the milled raw materials is preferably equal to or less than 10 μm and is more preferably equal to or less than 5 μm. Within the vibration mill or the ball mill, a medium having a predetermined particle diameter is preferably provided. Examples of the material of the medium include an iron-based chromium steel and an oxide-based zirconia, titania and alumina. As the form of the milling step, either of a continuous type and a batch type may be used. The particle diameter of the milled material is adjusted such as by a milling time, a rotation speed, the material and the particle diameter of the medium used.

Then, the milled slurry is granulated by being sprayed and dried. Specifically, the slurry is introduced into a spray drying machine such as a spray dryer, is sprayed into the atmosphere and is thereby granulated into a spherical shape. The temperature of the atmosphere at the time of the spray drying preferably falls within a range of 100 to 300° C. In this way, it is possible to obtain a spherical granulated material having a particle diameter of 10 to 200 μm. Preferably, for the obtained granulated material, a vibrating screen or the like is used, and thus coarse particles and fine powder are removed such that the particle size distribution becomes sharp.

Then, the granulated material is put into a furnace which is heated to a predetermined temperature, and is calcined so as to produce the ferrite particles. The calcination conditions are preferably set to a high temperature, a small amount of oxygen and a long period of time. In this way, the alkaline earth metal elements which are formed into ferrites are reduced and decomposed, and thus the powder pH is increased. The calcination temperature is preferably equal to or more than 1200° C. but equal to or less than 1250° C. The rate of temperature increase to the calcination temperature preferably falls within a range of 250 to 500° C./h. An oxygen concentration at the time of the calcination preferably falls within a range of 100 to 10000 ppm, and an oxygen concentration at the time of cooling preferably falls within a range of 10000 to 20000 ppm. In addition, when a gas whose humidity is 10% or more is introduced into the calcination atmosphere, $Sr(OH)_2$ is easily produced, and thus it is possible to adjust the powder pH to a desired value. The calcination time preferably falls within a range of 6 to 10 hours.

The ferrite particles obtained as described above are disintegrated as necessary. Specifically, for example, a hammer mill or the like is used to disintegrate the calcined material. As the form of the disintegration step, either of a continuous type and a batch type may be used. Then, as necessary, classification may be performed such that the particle diameters are made to fall within a predetermined range. As a classification method, a conventional known method such as air classification or sieve classification can be used. After primary classification is performed with an air classifier, with a vibration sieve or an ultrasonic sieve, the particle diameters may be made to fall within the predetermined range. Furthermore, after the classification step, non-magnetic particles may be removed with a magnetic field concentrator. The particle diameter of the ferrite particle preferably falls within a range of 20 to 60 μm.

Thereafter, as necessary, the ferrite particles after the classification are heated in an oxidizing atmosphere, and thus an oxide film is formed on the surface of the particles, with the result that the resistance of the ferrite particles may be increased (resistance increasing processing). As the oxidizing atmosphere, either of the atmosphere and the mixed atmosphere of oxygen and nitrogen may be used. The heating temperature preferably falls within a range of 200 to 800° C., and more preferably falls within a range of 250 to 600° C. The heating time preferably falls within a range of 0.5 to 5 hours.

Then, as necessary, magnetic selection processing is performed. In a magnetic selection step, a Na raw material component and a P raw material component which are unreacted are removed in a magnetic field of 1000 gauss for a staying time of three or more seconds. When the staying time is four or more seconds, the ferrite particles are sufficiently magnetized such that it is possible to remove the Na raw material component and the P raw material component which are unreacted. The staying time preferably falls within a range of 5 to 20 seconds.

Then, the surface of the main body of the produced ferrite particles is processed with the coupling agent. As the processing method, the coupling agent is first added to water or an alcohol aqueous solution, and thus a coupling agent aqueous solution is produced. The ferrite particles are put into an agitator where they are agitated, and the coupling agent aqueous solution is dropped or sprayed to the agitated ferrite particles. Then, the temperature is increased while the agitation is being continued such that the alcohol is volatilized. Thereafter, the ferrite particles are removed from the agitator and are dried with a dryer. After the drying, the ferrite particles are aggregated depending on the type of ferrite particles, and thus as necessary, disintegration processing is performed.

The coupling agent used in the present invention is not particularly limited, and a conventional known coupling agent can be used. For example, silane coupling agents such as glycidoxysilane, methacryloxysilane and aminosilane and titanium-based coupling agents can be used, and among them, the silane coupling agents are preferably used.

As the examples of glycidoxysilane, Z-6040 and Z-6043 (made by Dow Corning Toray Co., Ltd.), KBM 403 and KBE 403 (made by Shin-Etsu Chemical Co., Ltd.), A-186 and A-187 (Momentive Performance Materials Japan, LLC) and the like can be preferably used.

As the examples of methacryloxysilane, Z-6030 and Z-6033 (made by Dow Corning Toray Co., Ltd.), KBM 503 and KBE 503 (made by Shin-Etsu Chemical Co., Ltd.), A-174 and Y-9936 (Momentive Performance Materials Japan, LLC) and the like can be preferably used.

As the examples of aminosilane, Z-6610, Z-6020 and Z-6050 (made by Dow Corning Toray Co., Ltd.), KBM 603 and KBE 603 (made by Shin-Etsu Chemical Co., Ltd.), A-1110, A-1120 and Y-9669 (Momentive Performance Materials Japan, LLC) and the like can be preferably used.

As the examples of the titanium-based coupling agent, KR-TTS and KR-41B (made by Ajinomoto Co., Inc.) and the like can be preferably used.

The coupling agent which is used is preferably determined as necessary according to, for example, the type of resin with which the surface of the carrier core material is coated. When the coating resin is an acrylic resin or an acrylic/styrene mixed resin, as the coupling agent which is used, a silane coupling agent is preferably used which includes at least one type selected from a group consisting of an amino group, an epoxy group, a methacryl group, a vinyl group, a mercapto group, an isocyanate group and an alkyl group.

The detection of the coupling agent on the surface of the ferrite particles can be performed by use of a conventional known detection method, and for example, nuclear magnetic resonance (NMR) spectroscopy, mass spectrometry (MS), infrared spectroscopy (IR) and the like can be used. The coupling agent on the surface of the main body of the ferrite particles can also be detected from an SEM photogram and EDS element mapping.

As the amount of coupling agent used, a carbon content in the carrier core material which can be used as an index is preferably equal to or more than 0.005 mass % but equal to or less than 2.0 mass %. A method of measuring the carbon content will be described later.

The ferrite particles which are produced as described above are used as the carrier core material of the present invention. Then, in order for desired chargeability and the like to be obtained, the outer circumferential of the carrier core material is coated with the resin and is used as an electrophotographic development carrier.

As the resin with which the surface of the carrier core material is coated, a conventional known resin can be used. Examples thereof include polyethylene, polypropylene, polyvinyl chloride, poly-4-methylpentene-1, polyvinylidene chloride, an ABS (acrylonitrile-butadiene-styrene) resin, polystyrene, (meth) acrylic-based resins, an acrylic/styrene mixed resin, polyvinyl alcohol-based resins, thermoplastic elastomers such as polyvinyl chloride-based, polyurethane-based, polyester-based, polyamide-based and polybutadiene-based thermoplastic elastomers and fluorine silicone-based resins. In terms of intimate contact with the surface of the carrier core material in the present invention, (meth) acrylic-based resins and an acrylic/styrene mixed resin are particularly preferable.

As a method of coating the carrier core material with the resin, for example, a spray dry method, a fluidized bed method, a spray dry method using a fluidized bed, a dipping method and a dry coat method can be used. When the carrier core material of the present invention is coated, the dry coat method is particularly preferable.

With respect to the particle diameter of the carrier, in general, its volume average particle diameter preferably falls within a range of 10 to 200 μm, and more preferably falls within a range of 20 to 60 μm.

The electrophotographic developer according to the present invention is formed by mixing the carrier produced as described above and the toner. The mixing ratio between the carrier and the toner is not particularly limited, and is preferably determined, as necessary, from development conditions of a development device used or the like. In general, the concentration of the toner in the developer preferably falls within a range of 1 to 15 mass %. This is because when the concentration of the toner is less than 1 mass %, an image density is excessively lowered whereas when the concentration of the toner exceeds 15 mass %, the toner is scattered within the development device, and thus a stain within an apparatus may be produced or a failure may occur in which the toner is adhered to a background part of transfer paper or the like. The concentration of the toner more preferably falls within a range of 3 to 10 mass %.

As the toner, a toner can be used which is manufactured by a conventional known method such as a polymerization method, a milling/classification method, a melting granulation method or a spray granulation method. Specifically, a toner can be preferably used in which a coloring agent, a mold release agent, a charge control agent and the like are contained in a binder resin whose main component is a thermoplastic resin.

With respect to the particle diameter of the toner, in general, its volume average particle diameter by a coulter counter preferably falls within a range of 5 to 15 μm, and more preferably falls within a range of 7 to 12 μm.

A modifier may be added to the surface of the toner as necessary. Examples of the modifier include silica, alumina, zinc oxide, titanium oxide, magnesium oxide and polymethyl methacrylate. One or two or more types thereof can be combined and used.

The mixing of the carrier and the toner can be performed with a conventional known mixing device. For example, a Henschel mixer, a V-type mixer, a tumbler mixer and a hybridizer can be used.

EXAMPLES

Although the present invention will be more specifically described below using examples, the present invention is not limited at all to these examples.

Example 1

As raw materials, 21.5 kg of $Fe_2O_3$ (average particle diameter: 0.6 μm, $SiO_2$ content: 0.02 wt %), 10.4 kg of $Mn_3O_4$ (average particle diameter: 0.9 μm, $SiO_2$ content: 0.01 wt %) and 0.28 kg of $SrCO_3$ (average particle diameter: 0.6 μm) were dispersed in 10.0 kg of pure water, as a reducing agent, 120 g of carbon black was added and as a dispersant, 180 g of an ammonium polycarboxylate-based dispersant was added, with the result that a mixture was formed. The mixture was subjected to milling processing with a wet ball mill (medium diameter of 2 mm), and thus a mixed slurry was obtained.

The mixed slurry was sprayed with a spray drier into hot air of about 130° C., and thus a dried granulated material having a particle diameter of 10 to 75 μm was obtained. Minute particles whose particle diameter was equal to or less than 25 μm were removed from the granulated material with a sieve.

The granulated material was put into an electric furnace, and the temperature thereof was increased to 1200° C. in 4.5 hours. Thereafter, the granulated material was held at 1200° C. for 8 hours, and thus calcination was performed. Then, the granulated material was cooled to room temperature in 10 hours. Here, an oxygen concentration within the electric furnace was set to 5000 ppm at the time of the calcination, and was set to 1200 ppm at the time of the cooling.

The obtained calcined material was disintegrated with a hammer mill ("Hammer Crusher NH-34S" made by Sanshou Industry Co., Ltd., screen opening: 0.3 mm), and was classified with a vibration sieve, and then the obtained calcined material was held under the atmosphere at a temperature of 450° C. for 1.5 hours and was thereby subjected to oxidation processing (resistance increasing processing), with the result that ferrite particles were obtained.

The surface of the obtained ferrite particles was processed with a coupling agent, and thus a carrier core material subjected to the surface processing was produced. Specifically, 2 kg of the ferrite particles was mixed by use of a universal agitator (made by Dalton Corporation, model: 5DM-L-03-r) under the temperature of 30° C. for one hour with 2 g of 2-(3,4-epoxycyclohexyl) ethyltrimethoxysilane (0.1 wt % with respect to the ferrite particles), 500 g of methanol serving as a solvent (25 wt % with respect to the ferrite particles) and 20 g of water (1.0 wt % with respect to the ferrite particles). Thereafter, the temperature was increased to 120° C., thus the methanol serving as a solvent was volatilized and then agitation was performed for one hour. Heating processing was performed for 2 hours with an air dryer (made by Espec Corporation, model: PHH-102) set at 140° C., and the obtained dried material was subjected to disintegration processing with a vibration sieve having an opening of 75 μm, with the result that the carrier core material whose average particle diameter was 34.9 μm and whose surface was processed with the coupling agent was obtained.

The composition of the ferrite particles or the carrier core material obtained, the powder physical properties, the shape property, the magnetic property and the adherence rate of the coupling agent were measured with methods described later. The results of the measurements are shown in tables 1 and 2.

Example 2

A carrier core material having an average particle diameter of 34.8 μm was obtained by the same method as in example 1 except that as the Mn raw material, $Mn_3O_4$ ($SiO_2$ content: 0.5 wt %) was used. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

Example 3

A carrier core material having an average particle diameter of 34.3 μm was obtained by the same method as in example 2 except that the calcination temperature was set to 1250° C. and was held for 3 hours. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

Example 4

A carrier core material having an average particle diameter of 34.4 μm was obtained by the same method as in example 2 except that as raw materials, 21.5 kg of $Fe_2O_3$ (average particle diameter: 0.6 μm, $SiO_2$ content: 0.02 wt %), 7.5 kg of $Mn_3O_4$ (average particle diameter: 0.9 μm, $SiO_2$ content: 0.5 wt %), 1.0 kg of MgO (average particle diameter: 0.8 μm) and 0.17 kg of $CaCO_3$ (average particle diameter: 0.6 μm) were dispersed in 10.0 kg of pure water, as a reducing agent, 120 g of carbon black was added, as a dispersant, 180 g of an ammonium polycarboxylate-based dispersant was added, and thus a mixture was formed. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

Example 5

A carrier core material having an average particle diameter of 36.9 μm was obtained by the same method as in example 2 except that as raw materials, 21.5 kg of $Fe_2O_3$ (average particle diameter: 0.6 μm, $SiO_2$ content: 0.02 wt %), 7.5 kg of $Mn_3O_4$ (average particle diameter: 0.9 μm, $SiO_2$ content: 0.5 wt %), 1.0 kg of MgO (average particle diameter: 0.8 μm) and 1.0 kg of $SrCO_3$ (average particle diameter: 0.6 μm) were dispersed in 10.0 kg of pure water, as a reducing agent, 120 g of carbon black was added, as a dispersant, 180 g of an ammonium polycarboxylate-based dispersant was added and thus a mixture was formed. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

Comparative Example 1

A carrier core material having an average particle diameter of 34.5 μm was obtained by the same method as in example 2 except that the oxygen concentration within the electric furnace was set to 12000 ppm so as to be constant and that the oxidation processing was not performed. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

Comparative Example 2

A carrier core material having an average particle diameter of 34.4 μm was obtained by the same method as in example 2 except that as raw materials, 21.5 kg of $Fe_2O_3$ (average particle diameter: 0.6 μm, $SiO_2$ content: 0.02 wt %), 7.5 kg of $Mn_3O_4$ (average particle diameter: 0.9 μm, $SiO_2$ content: 0.5 wt %), 1.0 kg of MgO (average particle diameter: 0.8 μm) and 0.25 kg of $SrCO_3$ (average particle diameter: 0.6 μm) were dispersed in 10.0 kg of pure water, as a reducing agent, 120 g of carbon black was added, as a dispersant, 180 g of an ammonium polycarboxylate-based dispersant was added, thus a mixture was formed and the mixture was held at 1170° C. for 3 hours so as to be calcined. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

Comparative Example 3

A carrier core material having an average particle diameter of 34.8 μm was obtained by the same method as in example 2 except that 0.09 kg of $TiO_2$ was added to the raw materials. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

Comparative Example 4

A carrier core material having an average particle diameter of 36.9 μm was obtained by the same method as in example 2 except that as raw materials, 10.78 kg of $Fe_2O_3$ (average particle diameter: 0.6 μm, $SiO_2$ content: 0.02 wt %), 4.22 kg of $Mn_3O_4$ (average particle diameter: 0.9 μm, $SiO_2$ content: 0.5 wt %), 0.25 kg of $SrCO_3$ (average particle diameter: 0.6 μm) were dispersed in 10.0 kg of pure water, as a sintering auxiliary agent, 30 g of Snowtex 50 ($SiO_2$ content: 48 wt %), as a reducing agent, 120 g of carbon black was added, as a dispersant, 180 g of an ammonium polycarboxylate-based dispersant was added and thus a mixture was formed. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

Comparative Example 5

A carrier core material having an average particle diameter of 33.6 μm was obtained by the same method as in example 5 except that $SrCO_3$ was not added. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

Comparative Example 6

A carrier core material having an average particle diameter of 35.5 μm was obtained by the same method as in comparative example 4 except that $SrCO_3$ was not added. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

Comparative Example 7

A carrier core material having an average particle diameter of 35.5 μm was obtained by the same method as in comparative example 6 except that in the coupling processing, ammonia water was added to the solvent such that the pH of the solvent was adjusted to be 11. The composition of the ferrite particles or the carrier core material obtained, the powder physical properties, the shape property, the magnetic property and the adherence rate of the coupling agent were measured with the same methods as described in example 1. The results of the measurements are shown in tables 1 and 2.

(Composition Analysis)

(Analysis of Fe)

The ferrite particles containing iron element were weighed and dissolved in mixed acid water of hydrochloric acid and nitric acid. This solution was evaporated to dryness and was thereafter dissolved again by adding sulfuric acid water thereto, and thus excessive hydrochloric acid and nitric acid were volatilized. Solid aluminum was added to this solution, and thus all $Fe^{3+}$ ions in the liquid were reduced to $Fe^{2+}$ ions. Then, the amount of $Fe^{2+}$ ions in this solution was subjected to potentiometric titration using a potassium permanganate solution, and thus quantitative analysis was performed, with the result that the titer of Fe ($Fe^{2+}$) was determined.

(Analysis of Mg)

The content of Mg in the ferrite particles was analyzed by the following method. The ferrite particles according to the invention of the present application were dissolved in an acid solution, and quantitative analysis was performed by ICP. The content of Mg in the ferrite particles described in the invention of the present application is the amount of Mg which was obtained by performing the quantitative analysis with ICP.

(Analysis of Mn)

For the content of Mn in the ferrite particles, quantitative analysis was performed according to a ferromanganese analysis method (potentiometric titration method) described in JIS G 1311-1987. The content of Mn in the ferrite particles described in the present invention is the amount of Mn which was obtained by performing the quantitative analysis with the ferromanganese analysis method (potentiometric titration method).

(Analysis of Sr)

The content of Sr in the ferrite particles was determined by quantitative analysis with ICP as in the analysis of Mg.

(Analysis of Ca)

The content of Ca in the ferrite particles was determined by quantitative analysis with ICP as in the analysis of Mg.

(Analysis of Al)

The content of Al in the ferrite particles was determined by quantitative analysis with ICP as in the analysis of Mg.

(Analysis of Cr)

The content of Cr in the ferrite particles was determined by quantitative analysis with ICP as in the analysis of Mg.

(Analysis of Mo)

The content of Mo in the ferrite particles was determined by quantitative analysis with ICP as in the analysis of Mg.

(Analysis of Ti)

The content of Ti in the ferrite particles was determined by quantitative analysis with ICP as in the analysis of Mg.

(Analysis of Si Content)

The content of $SiO_2$ in the ferrite particles was determined by a silicon dioxide weight method according to JIS M8214-1995. Then, the content of Si was calculated from the determined the amount of $SiO_2$ using the following formula.

$$\text{Si content (mass \%)} = SiO_2 \text{ amount (mass \%)} \times 28.09 \text{ (mol/g)} / 60.09 \text{ (mol/g)}$$

(Measurement of Powder pH)

The ferrite particles were dry-milled using beads of 1/16 inches with a vibration mill for 8 hours. Then, 10.0 g of the milled ferrite particles was put into an Erlenmeyer flask in which 300 ml of ultra-pure water at a temperature of 23° C. was stored. Then, a shaker was used to agitate the Erlenmeyer flask for 5 minutes. After the agitation, a supernatant was rapidly collected, and the pH thereof was measured with a pH meter (pH meter HM-30R made by DKK-TOA CORPORATION).

Although the powder pH of the ferrite particles was measured without milling being performed, since an eluted component only on the surface of the ferrite particles was evaluated, a clear relationship with the amount of coupling agent adhered was not obtained, with the result that an accurate evaluation was not achieved.

(Maximum Height Rz, Average Length RSm)

An ultra-deep color 3D shape measuring microscope ("VK-X100" made by Keyence Corporation) was used to observe the surface with a 100× objective lens and thereby determine the maximum height Rz and the average length RSm. Specifically, the ferrite particles were first fixed to an adhesive tape whose surface was flat, a measurement view was determined with the 100× objective lens and thereafter an autofocus function was used to adjust a focal point to the surface of the adhesive tape. A laser beam was applied from a vertical direction (Z direction) to the flat surface of the adhesive tape to which the ferrite particles were fixed, and the surface was scanned in an X direction and in a Y direction. The positions of the heights of the lens when the intensity of light reflected off the surface was maximized were connected together, and thus data in the Z direction was acquired. The pieces of position data in the X, Y and Z directions were connected together, and thus the three-dimensional shape of the surface of the ferrite particles was obtained. In order to capture the three-dimensional shape of the surface of the ferrite particles, an auto-shooting function was used.

The measurements of individual parameters were performed with particle roughness inspection software (made by Mitani Corporation). First, as preprocessing, particle recognition and shape selection were performed on the three-dimensional shape of the surface of the ferrite particles obtained. The particle recognition was performed by the following method. In the three-dimensional shape obtained by the shooting, it was assumed that the maximum value in the Z direction was 100% and that the minimum value in the Z direction was 0%, and the section between the maximum value and the minimum value was divided into 100 equal parts. The region between 35% and 100% was extracted, and the outline of the independent region was recognized as the outline of the particle. Then, particles such as coarse particles, minute particles and associated particles were removed by the shape selection. The shape selection is performed, and thus it is possible to reduce an error at the time of curvature correction to be performed later. Specifically, particles whose area equivalent diameter was equal to or less than 28 μm but equal to or more than 38 μm and whose acicular ratio was equal to or more than 1.15 were removed. Here, the acicular ratio is a parameter which is calculated from a ratio of the maximum length/the diagonal width in the particle, and the diagonal width indicates, when the particle is sandwiched between two straight lines parallel to the maximum length, the shortest distance of the two straight lines.

Then, a portion which was used for analysis was removed from the three-dimensional shape of the surface. First, a square of 15.0 μm was drawn with a barycenter determined from the outline of the particle recognized by the above method being the center. In the drawn square, 21 parallel lines were drawn, and roughness curves on the line segments thereof equivalent to 21 lines were removed.

Since the ferrite particle was formed substantially in the shape of a sphere, the removed roughness curve had a given curvature as a background. Hence, as the correction of the background, the optimal quadratic curve was fitted and was subtracted from the roughness curve. In this case, a low-pass filter was applied with the intensity of 1.5 μm, and a cutoff value λ was set to 80 μm.

The average particle diameter of the carrier core material which was used for the analysis was limited to be 32 to 34 μm. The average particle diameter of the carrier core material which is the target to be measured is limited to a narrow range, and thus it is possible to reduce an error caused by a residue produced by the curvature correction.

The maximum height Rz was determined as a sum of the height of the highest peak and the depth of the deepest trough in the roughness curve. In the calculation of the maximum height Rz, as the average value of the parameters, the average value of 30 particles was used.

The average length RSm is obtained by specifying, in the roughness curve, a combination of a trough and a peak as one element and averaging the lengths of the individual elements. In the calculation of the average length RSm, as the average value of the parameters, the average value of 30 particles was used.

The measurements of the maximum height Rz and the average length RSm described above were performed according to JIS B0601 (2001 edition).

(Volume Average Particle Diameter (Average Particle Diameter), $D_{50}$)

The volume average particle diameter of the carrier core material was measured with a laser diffraction type particle size distribution measuring device ("Microtrac Model 9320-X100" made by Nikkiso Co., Ltd.).

(Apparent Density, AD)

The apparent density of the carrier core material was measured according to JIS Z 2504.

(Fluidity, FR)

The fluidity of the carrier core material was measured according to JIS Z 2502.

(Magnetic Properties)

A room-temperature dedicated vibration sample type magnetometer (VSM) ("VSM-P7" made by Toei Industry Co., Ltd.) was used to apply an external magnetic field in a range of 0 to $79.58\times10^4$ A/m (10000 oersteds) continuously in one cycle, and thus a saturated magnetization, a residual magnetization, a coercive force (Oe: $A/m\times10^3/(4\pi)$) and a magnetization $\sigma_{1k}$ ($Am^2/kg$) in a magnetic field of $79.58\times10^3$ A/m (1000 oersteds) were individually measured.

(Adherence Rate of Coupling Agent)

A carbon content in the carrier core material was measured by an infrared absorption method. Specifically, 1 g of the carrier core material was burned in an oxygen current, thus carbon contained in the carrier core material was converted into carbon dioxide, an infrared absorption detector (made by LECO Japan Corporation, carbon sulfur analyzer "CS-200 model") was used to measure the amount of infrared light absorbed by carbon dioxide and thereby a carbon content was calculated.

On the other hand, a carbon content in the coupling agent added to the ferrite particles was measured from the following formula.

carbon content in coupling agent=(added amount)×(number of carbons in coupling agent)×12/molecular weight The number of carbons in the coupling agent is the number of carbons after hydrolysis.

Then, a ratio of the coupling agent adhered to the ferrite particles was calculated from the following formula.

(carbon content in carrier core material)/(carbon content in coupling agent added)×100(%)

The carbon content in the ferrite particles was extremely low as compared with the carbon content in the carrier core material after the coupling processing so as to be negligible.

TABLE 1

| | Composition determined by ICP (wt %) | | | | | | | | | | Total content of Al, |
|---|---|---|---|---|---|---|---|---|---|---|---|
| | Fe | Mg | Mn | Sr | Ca | Al | Cr | Mo | Ti | Si | Cr, Mo, Ti, Si (wt %) |
| Example 1 | 48.7 | 0.26 | 22.8 | 0.58 | 0.053 | 0.024 | 0.035 | 0.002 | 0.004 | 0.016 | 0.08 |
| Example 2 | 48.6 | 0.25 | 22.8 | 0.56 | 0.062 | 0.039 | 0.022 | 0.002 | 0.008 | 0.040 | 0.11 |
| Example 3 | 48.8 | 0.25 | 22.8 | 0.60 | 0.053 | 0.042 | 0.024 | 0.002 | 0.004 | 0.028 | 0.10 |
| Example 4 | 51.5 | 4.61 | 23.7 | 0.04 | 0.140 | 0.036 | 0.025 | 0.002 | 0.006 | 0.025 | 0.09 |
| Example 5 | 50.4 | 4.38 | 22.8 | 2.10 | 0.089 | 0.033 | 0.022 | 0.002 | 0.004 | 0.022 | 0.08 |
| Comparative example 1 | 48.7 | 0.25 | 22.8 | 0.56 | 0.056 | 0.032 | 0.030 | 0.002 | 0.004 | 0.024 | 0.09 |
| Comparative example 2 | 51.8 | 4.61 | 24.3 | 0.53 | 0.057 | 0.029 | 0.032 | 0.002 | 0.004 | 0.033 | 0.10 |
| Comparative example 3 | 48.4 | 0.19 | 22.4 | 0.51 | 0.054 | 0.036 | 0.021 | 0.002 | 0.067 | 0.029 | 0.16 |
| Comparative example 4 | 51.6 | 0.19 | 19.8 | 0.53 | 0.061 | 0.035 | 0.030 | 0.002 | 0.004 | 0.123 | 0.19 |
| Comparative example 5 | 51.5 | 4.70 | 23.8 | 0.04 | 0.036 | 0.034 | 0.025 | 0.002 | 0.004 | 0.038 | 0.10 |
| Comparative example 6 | 51.9 | 0.18 | 20.1 | 0.03 | 0.039 | 0.034 | 0.022 | 0.002 | 0.006 | 0.131 | 0.20 |
| Comparative example 7 | 51.9 | 0.18 | 20.1 | 0.03 | 0.039 | 0.034 | 0.022 | 0.002 | 0.006 | 0.131 | 0.20 |

TABLE 2

| | Powder pH | AD g/cm³ | FR sec/50 g | $D_{50}$ μm | RSm μm | Rz μm | σs $Am^2/kg$ | $\sigma_{1k}$ $Am^2/kg$ | σr $Am^2/kg$ | Hc Oe | Coupling agent adherence rate (%) |
|---|---|---|---|---|---|---|---|---|---|---|---|
| Example 1 | 11.4 | 2.24 | 35.0 | 34.9 | 7.27 | 2.4 | 68.5 | 58.8 | 0.8 | 5.1 | 96 |
| Example 2 | 10.5 | 2.23 | 34.8 | 34.8 | 7.26 | 2.4 | 68.1 | 59.0 | 0.7 | 7.9 | 93 |
| Example 3 | 9.5 | 2.25 | 30.2 | 34.3 | 7.34 | 2.5 | 69.1 | 58.1 | 0.9 | 10.2 | 81 |
| Example 4 | 9.5 | 2.24 | 30.1 | 34.4 | 7.16 | 1.7 | 68.1 | 57.8 | 0.8 | 6.1 | 82 |
| Example 5 | 11.0 | 2.25 | 35.0 | 36.9 | 7.42 | 1.9 | 67.3 | 56.5 | 1.0 | 11.3 | 96 |
| Comparative example 1 | 8.6 | 2.25 | 29.9 | 34.5 | 7.28 | 2.3 | 68.1 | 59.1 | 0.7 | 8.0 | 49 |
| Comparative example 2 | 8.5 | 2.21 | 31.5 | 34.7 | 7.39 | 2.4 | 69.8 | 58.3 | 1.0 | 11.1 | 58 |
| Comparative example 3 | 8.1 | 2.21 | 30.5 | 34.8 | 7.18 | 2.2 | 69.0 | 58.4 | 1.2 | 8.9 | 22 |
| Comparative example 4 | 7.6 | 2.26 | 28.8 | 36.9 | 7.66 | 2.0 | 81.6 | 66.1 | 0.7 | 8.1 | 24 |
| Comparative example 5 | 7.0 | 2.25 | 32.5 | 33.6 | 6.60 | 1.3 | 68.2 | 60.2 | 0.6 | 6.1 | 30 |
| Comparative example 6 | 7.1 | 2.40 | 35.5 | 35.5 | 6.98 | 1.4 | 82.4 | 68.2 | 0.6 | 8.0 | 21 |

TABLE 2-continued

| | Powder pH | AD g/cm$^3$ | FR sec/50 g | $D_{50}$ μm | RSm μm | Rz μm | σs Am$^2$/kg | $\sigma_{1k}$ Am$^2$/kg | σr Am$^2$/kg | Hc Oe | Coupling agent adherence rate (%) |
|---|---|---|---|---|---|---|---|---|---|---|---|
| Comparative example 7 | 7.1 | 2.40 | 35.5 | 35.5 | 6.98 | 1.4 | 82.4 | 68.2 | 0.6 | 8.0 | 24 |

As is clear from table 2, the carrier core material of example 1 was formed with the Mn ferrite particles whose powder pH was 11.4, the surface of the Mn ferrite particles was processed with the coupling agent and thus the adherence rate of the coupling agent was 96%, with the result that the coupling agent was uniformly adhered to the entire surface of the Mn ferrite particles.

In the ferrite particles of example 2 in which the $SiO_2$ content serving as the Mn component raw material was higher than in example 1 so as to be 0.5 wt %, though the powder pH was slightly lower than that of the ferrite particles of example 1 so as to be 10.5, the adherence rate of the coupling agent was high so as to be 93%. In the ferrite particles of example 3 in which the calcination temperature was set higher than and the calcination time was set shorter than in example 2, though the powder pH was still lower than that of the ferrite particles of example 2 so as to be 9.5, the adherence rate of the coupling agent was practicable so as to be 96%.

The carrier core material of example 4 was formed with the Mn—Mg ferrite particles to which the Ca component was added, the powder pH was high so as to be 11.0, the surface of the Mn—Mg ferrite particles was processed with the coupling agent and thus the adherence rate of the coupling agent was practicable so as to be 82%.

The carrier core material of example 5 was formed with the Mn—Mg ferrite particles to which the Sr component was added, the powder pH was high so as to be 9.5, the surface of the Mn—Mg ferrite particles was processed with the coupling agent and thus the adherence rate of the coupling agent was 96%, with the result that the coupling agent was uniformly adhered to the entire surface of the Mn—Mg ferrite particles. On the other hand, in the carrier core material of comparative example 5 to which the Sr component was not added, the powder pH was low so as to be 7.0 and thus the adherence rate of the coupling agent was impracticable so as to be 30%.

By contrast, in the ferrite particles of comparative example 1 in which the oxygen concentrations at the time of the calcination and at the time of the cooling were higher than in example 2 so as to be 12000 ppm and in which the oxidization processing was not performed, the powder pH was low so as to be 8.6 and thus the adherence rate of the coupling agent was impracticable so as to be 49%.

In the ferrite particles of comparative example 2 in which the calcination temperature was set lower than and the calcination time was set shorter than in example 2, the powder pH was low so as to be 8.5 and thus the adherence rate of the coupling agent was impracticable so as to be 58%.

In the ferrite particles of comparative example 3 to which as the component raw material, Ti was added, the powder pH was low so as to be 8.1 and thus the adherence rate of the coupling agent was impracticable so as to be 22%.

In the ferrite particles of comparative example 4 in which the sintering auxiliary agent containing Si was used, the powder pH was low so as to be 7.6 and thus the adherence rate of the coupling agent was impracticable so as to be 24%. In the ferrite particles of comparative example 6 in which the sintering auxiliary agent containing Si was used and in which the Sr component raw material was not used, the powder pH was further low so as to be 7.1 and thus the adherence rate of the coupling agent was impracticable so as to be 21%. Hence, in comparative example 7, though ammonia water was added to the solvent such that the pH of the coupling agent solution was increased to 11, the powder pH of the ferrite particles was not so changed with respect to the comparative example 6 as to be 7.1 and thus the adherence rate of the coupling agent was impracticable so as to be 24%.

INDUSTRIAL APPLICABILITY

The carrier core material according to the present invention is useful because a coupling agent can be uniformly adhered to the entire surface.

The invention claimed is:

1. An electrophotographic carrier core material that is formed with ferrite particles, wherein a volume average particle diameter of the ferrite particles is equal to or more than 20 μm but equal to or less than 60 μm, a maximum height Rz of the ferrite particles is equal to or more than 1.5 μm but equal to or less than 3.0 μm, and a powder pH of the ferrite particles is equal to or more than 9.

2. The electrophotographic carrier core material according to claim 1, wherein the ferrite particles are formed of Mn ferrite or Mn—Mg ferrite.

3. The electrophotographic carrier core material according to claim 1, wherein the ferrite particles contain 45 wt % or more but 65 wt % or less of Fe, 15 wt % or more but 30 wt % or less of Mn and 5 wt % or less of Mg.

4. The electrophotographic carrier core material according to claim 1, wherein the ferrite particles contain 0.1 wt % or more but 3.0 wt % or less of Sr and/or Ca as a total amount.

5. The electrophotographic carrier core material according to claim 1, wherein a total content of elements of Al, Cr, Mo, Si and Ti in the ferrite particles is equal to or less than 0.15 wt %.

6. The electrophotographic carrier core material according to claim 1, wherein an average length RSm of the ferrite particles is equal to or more than 7 μm but equal to or less than 8 μm.

7. The electrophotographic carrier core material according to claim 1, wherein a magnetization $\sigma_{1k}$ is equal to or more than 50 Am$^2$/kg but equal to or less than 70 Am$^2$/kg.

8. The electrophotographic carrier core material according to claim 1, wherein a coupling agent is adhered to a surface of the ferrite particles.

9. The electrophotographic carrier core material according to claim 8, wherein the coupling agent is a coupling agent which includes at least one type selected from a group consisting of an amino group, an epoxy group, a methacryl group, a vinyl group, a mercapto group, an isocyanate group and an alkyl group.

10. An electrophotographic development carrier, wherein the electrophotographic development carrier has a resin coating layer on a surface of the electrophotographic carrier core material according to claim 8.

11. An electrophotographic developer comprising:

the electrophotographic development carrier according to claim 10; and a toner.

12. An electrophotographic development carrier, wherein the electrophotographic development carrier has a resin coating layer on a surface of the electrophotographic carrier core material according to claim 9.

13. An electrophotographic developer comprising:

the electrophotographic development carrier according to claim 12; and a toner.

* * * * *